US009532413B2

(12) United States Patent
Wallius et al.

(10) Patent No.: US 9,532,413 B2
(45) Date of Patent: Dec. 27, 2016

(54) LED CURRENT GENERATION

(71) Applicant: Nokia Corporation, Espoo (FI)

(72) Inventors: Samuli Wallius, Turku (FI); Pekka Hyppönen, Salo (FI); Kai Jämsä, Lieto (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/219,865

(22) Filed: Mar. 19, 2014

(65) Prior Publication Data

US 2015/0271880 A1 Sep. 24, 2015

(51) Int. Cl.
*H05B 33/08* (2006.01)

(52) U.S. Cl.
CPC ..... *H05B 33/0815* (2013.01)

(58) Field of Classification Search
CPC ..... H02J 7/345; H02J 7/35; H02J 7/0065; H02J 7/025; H02J 7/0055; H02J 5/005; H02J 7/0019; H02J 7/0054; H02J 7/0075; H02J 13/001; H02J 2003/143; H02J 3/14; H02J 3/32; H02J 7/00; H02J 7/0016; H02J 7/02; H05B 33/0815; H05B 33/0827; H05B 41/325; H05B 33/0809; H05B 33/0854; H05B 33/10; H05B 37/02; H05B 33/08; H04N 7/185; H04N 5/2256; H04N 1/00307; H04N 1/00885; H04N 1/00896; H04N 1/0282; H04N 1/40056; H04N 5/23241; H04N 7/183; H04N 5/2354; H01H 36/0006; H02M 3/158; H02M 3/07; H02M 3/1582; H04W 88/02; H04W 52/0261; H04W 76/04; H04W 92/18; H04W 84/18; H01L 25/00; H01L 35/00; H01M 16/00; H01M 10/052; H01M 10/0525; H01M 10/30; H01M 10/345; H01M 10/425; H01M 10/445; H01M 10/46; H01M 10/48; H01M 10/486; H01M 2200/20; H01M 2250/30; H01M 8/065; H01M 8/0662; H04M 1/22; H04M 19/08; H04M 1/312; H04M 1/50; H04M 1/53; H04M 1/6025; H04M 1/6033; G05F 1/46; G05F 1/652
USPC ..... 315/160–176
See application file for complete search history.

(56) References Cited

U.S. PATENT DOCUMENTS

| | | | | |
|---|---|---|---|---|
| 8,044,610 | B2 | 10/2011 | Sandner et al. | |
| 2008/0203946 | A1 * | 8/2008 | Ito | H05B 33/083 315/307 |
| 2009/0167260 | A1 * | 7/2009 | Pauritsch | H02J 7/0065 323/233 |
| 2013/0181523 | A1 | 7/2013 | Zhang et al. | |

* cited by examiner

*Primary Examiner* — Alexander H Taningco
*Assistant Examiner* — Seokjin Kim
(74) *Attorney, Agent, or Firm* — Mintz Levin Cohn Ferris Glovsky and Popeo, P.C.

(57) ABSTRACT

Methods and apparatus, including computer program products, are provided for LED current generation. In one aspect there is provided a method, which may include receiving, at combiner circuitry, a first current from a light emitting diode driver circuitry; receiving, at the combiner circuitry, a second current from at least one of a capacitor or a battery; combining, by the combiner circuitry, the first current with the second current to form an augmented current, wherein the augmented current is based on at least a first value of a first resistor and a second value of a second resistor; and outputting, by the combiner circuitry, the augmented current to drive at least one light emitting diode. Related systems, articles of manufacture, and the like are also disclosed.

17 Claims, 5 Drawing Sheets

$I_{total} = I_{set} * (1 + R_{set} / R_{boost})$ $I_{total} = I_{set} * (1 + R_{set} / R_{boost})$

LED CURRENT GENERATION

FIELD

The subject matter described herein relates to driving light emitting diodes (LEDs).

BACKGROUND

Light emitting diodes (LEDs) may receive power from a driver, also referred to an LED driver. The LED driver may couple to a power source and generate, under the control of a digital control signal, an output current to drive one or more LEDs. The LED driver may thus generate the output current to drive the one or more LEDs serving as for example a flash, as well as any other type of light source.

SUMMARY

Methods and apparatus, including computer program products, are provided for LED current generation.

In some example embodiments, there is provided method, which may include receiving, at combiner circuitry, a first current from a light emitting diode driver circuitry; receiving, at the combiner circuitry, a second current from at least one of a capacitor or a battery; combining, by the combiner circuitry, the first current with the second current to form an augmented current, wherein the augmented current is based on at least a first value of a first resistor and a second value of a second resistor; and outputting, by the combiner circuitry, the augmented current to drive at least one light emitting diode.

In some variations, one or more of the features disclosed herein including the following features can optionally be included in any feasible combination. The augmented current may be based on at least a ratio of the first value of the first resistor and the second value of the second resistor. The combiner circuitry may include an operational amplifier, a current controller, the first resistor, and the second resistor. A first input of the operation amplifier may be coupled in parallel to the first resistor and the first current received from the light emitting diode driver circuitry. The current controller may include a transistor. The second input of the operation amplifier may be coupled in parallel to an emitter of the transistor and the second resistor. An output of the operation amplifier may be coupled to a base of the transistor.

The above-noted aspects and features may be implemented in systems, apparatus, methods, and/or articles depending on the desired configuration. The details of one or more variations of the subject matter described herein are set forth in the accompanying drawings and the description below. Features and advantages of the subject matter described herein will be apparent from the description and drawings, and from the claims.

Figure 1:
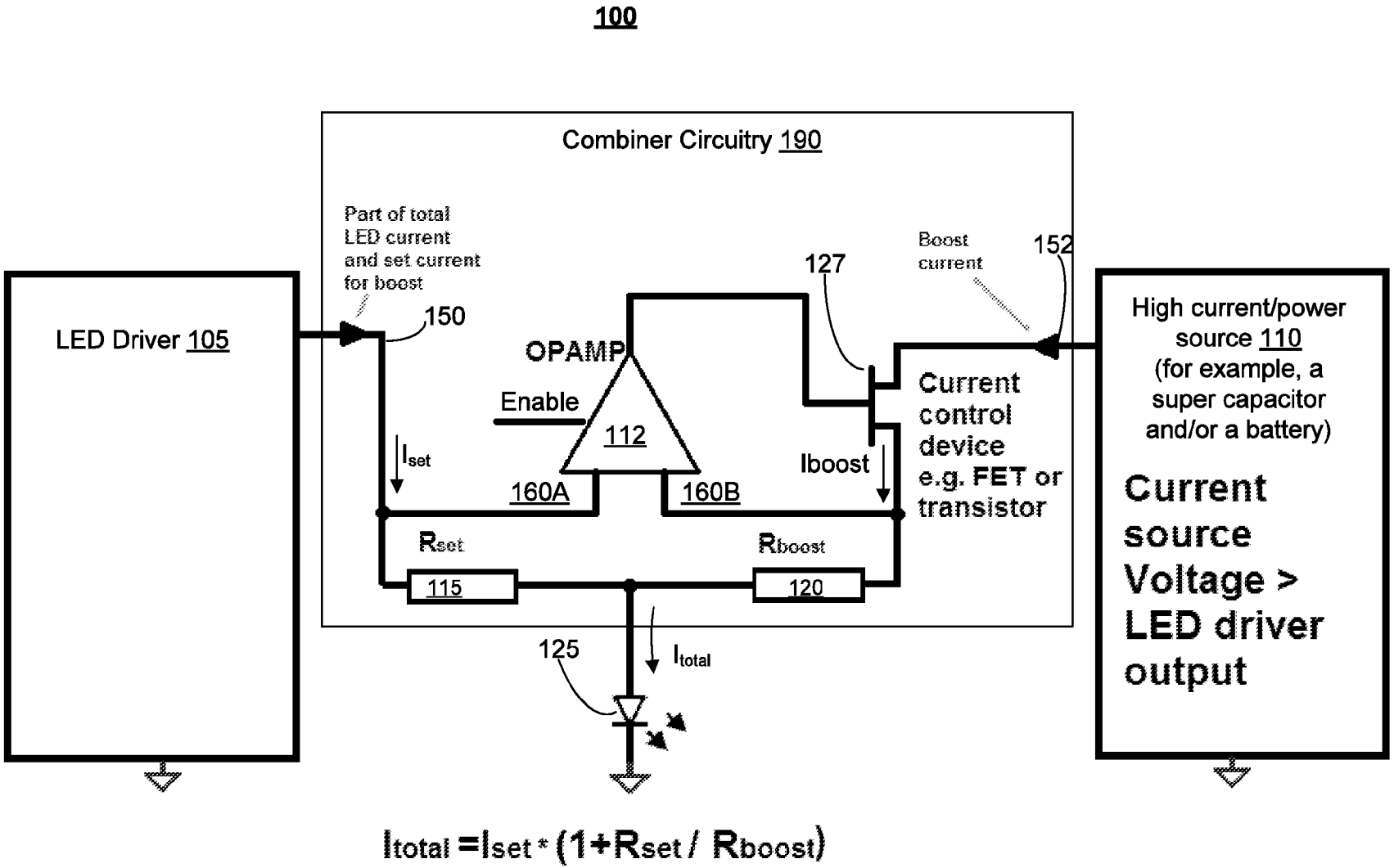
FIG. 1 depicts an example of a system for generating currents for LEDs, in accordance with some example embodiments.

Like labels are used to refer to same or similar items in the drawings.

DETAILED DESCRIPTION

FIG. 1 depicts an example of an apparatus 100 including a light emitting diode (LED) driver 105, combiner circuitry 190, a high current and/or power source 110 to boost the current provided by LED driver 105, and one or more light emitting diodes, such as light emitting diode 125, in accordance with some example embodiments. The combiner circuitry 190 may further include an operational amplifier 112, a first resister 115 (labeled $R_{set}$), a second resistor 120 (labeled $R_{boost}$), and a current controller 127, such as a transistor, field effect transistor, and the like. The high current and/or power source 110 may comprise at least one super capacitor and/or at least one battery.

In some example embodiments, the LED driver's 105 current output 150 may be combined, by combiner circuitry 190, with current output 152 from high current/power source 110 to produce an augmented current, $I_{total}$, that drives LED 125.

In some example embodiments, the values of first resistor 115 (labeled $R_{set}$) and second resistor 120 (labeled $R_{boost}$) may be selected to provide a certain current total, $I_{total}$, which augments the set current provided by LED driver 105.

The LED driver 105 may comprise circuitry in a user equipment, such as a phone, a camera, a smartphone, and/or any other device, and this circuitry may provide a current output 150 generated from, for example, one or more charged capacitors and/or other power sources, such as a battery. For example, when a control signal strobes LED driver 105, LED driver 105 may provide a current to power LED 125, which may be used as a flash or other type of light source.

Moreover, output current 150 of LED driver 105 may be coupled in parallel to a first input of operational amplifier 112 and first resistor 115. The operational amplifier 112 may also have a second input coupled to for example an emitter of current controller 127 and second resistor 120.

Second resistor 120 and first resistor 115 may both be further coupled to LED 125. Furthermore, the current control device 127 may be coupled to the output of operational amplifier 112. The input of current control device 127 may be further coupled to a high current (or power source) 110, such as a super capacitor and/or a battery.

The high current (or power source) 110 may provide a boost current output 152, which may serve to augment current output 150, in accordance with some example embodiments. The operational amplifier 112 may be configured as a difference amplifier that controls current control device 127, so that the voltage across the first resistor 115 ($R_{set}$) is the same, or similar to, the voltage across the second resistor 120 ($R_{boost}$).

As noted, the values of first resister 115 (labeled $R_{set}$) and second resistor 120 (labeled $R_{boost}$) may be selected to provide a certain current total, $I_{total}$. This current, $I_{total}$, may represent a current that augments the set current, $I_{set}$, provided by LED driver 105. For example, operational amplifier 112 output may turn on current controller 127 in order to keep the voltages at inputs 160A-B at a relatively constant voltage. As such, the current flow through first resister 115 and second resistor 120 (and thus LED 125) may be a function of the values of first resister 115 and second resistor 120.

In some example embodiments, the ratio of $I_{set}$ to $I_{boost}$ may be substantially constant, and may depend on the ratio of resistor values $R_{set}$ and $R_{boost}$. As such, the current, $I_{total}$, through LED 125 may be a combination of LED driver current output 150 and the current 152 from high voltage energy source 110. This current combination may also be a function of the ratio of resistors $R_{set}$ and $R_{boost}$. In some example embodiments, LED 125 may receive a total current total, $I_{total}$, that is a function of a ratio of resistor values $R_{set}$ and $R_{boost}$ in accordance with the following equation:

$$I_{total}=I_{set}*(1+R_{set}/R_{boost}) \quad \text{Equation 1,}$$

wherein $I_{total}$ corresponds to the total, augmented current flowing into LED 125;

$I_{set}$ corresponds to the current output 150; and $R_{set}/R_{boost}$ corresponds to a ratio between $R_{set}$ 115 and $R_{boost}$ 120.

To illustrate Equation 1 above, if the ratio of $R_{set}$ to $R_{boost}$ is 2, then the $I_{total}$ flowing into LED 125 would be 3 times the value of the $I_{set}$, i.e., output current 150 of LED driver 105. Apparatus 100 may thus allow an output current ($I_{set}$) 150 from an LED driver 105 to be augmented, by combiner circuitry 190, using the current output $I_{boost}$ 152 from high current source 110.

Figure 2A:
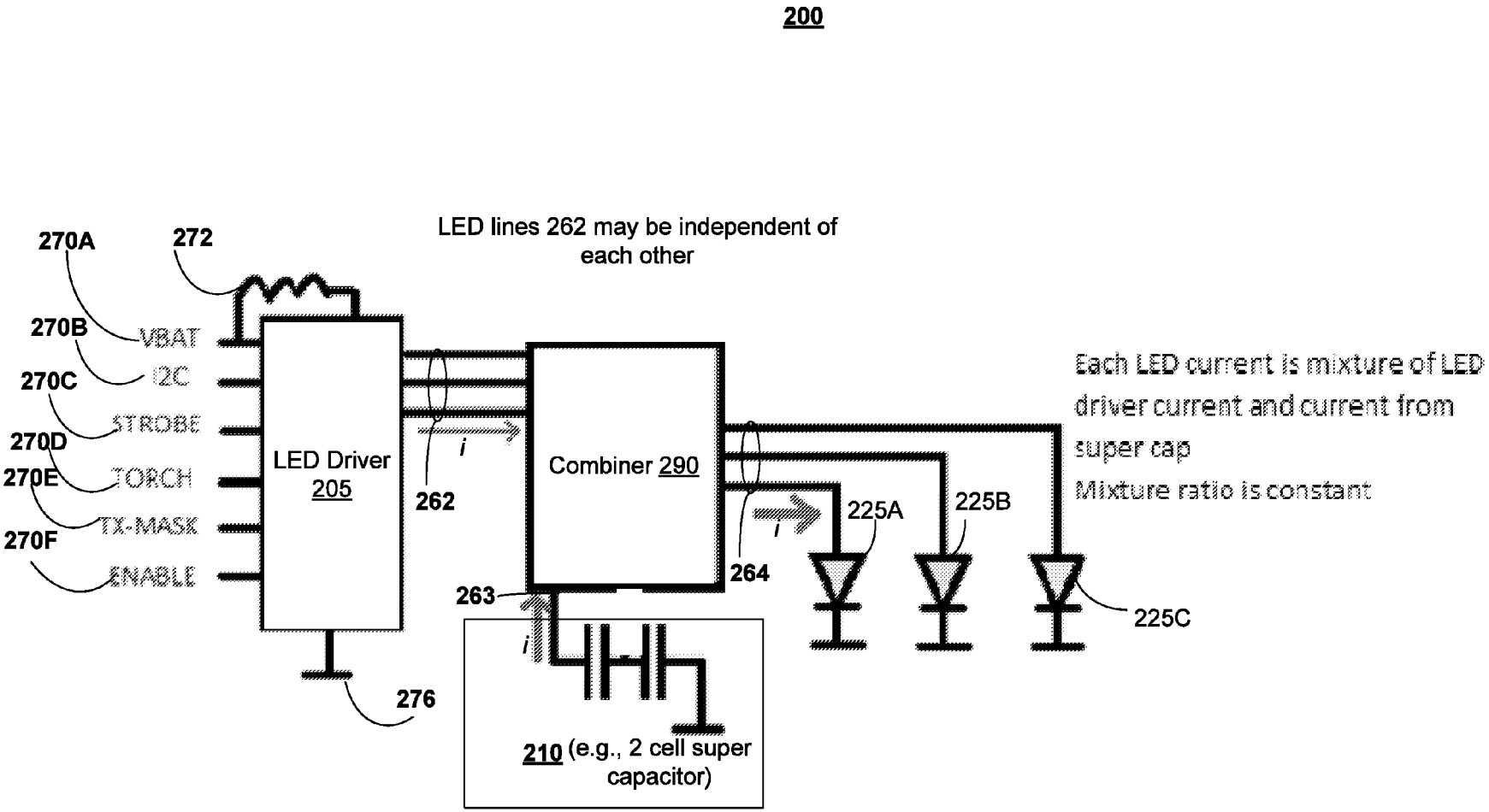
FIG. 2A depicts another example of a system for generating currents for LEDs, in accordance with some example embodiments.

FIG. 2A depicts an apparatus 200, in accordance with some example embodiments. Apparatus 200 is similar to apparatus 100 in some respects but includes, among other things, a plurality of LEDs 225A-C and combiner circuitry 290 configured to provide three current outputs at 264 to LEDs 225A-C.

Apparatus 200 may include LED driver 205 configured to output one or more currents 262 to combiner circuitry 290. The combiner circuitry 290 may receive as inputs current signals 262 and receive currents 263 from a high current/power source 210). The combiner circuitry 290 may be implemented in a manner similar to combiner circuitry 190 but include additional components to accommodate 3 input currents (which are output currents 262) and generate output currents 264 to each of the LEDs 225A-C. In addition, output currents 264 may be a function of the $R_{set}$ and $R_{boost}$ resistors in accordance with Equation 1 above.

Although FIG. 2A depicts a certain quantity of LED driver signals 262, high current/power signals 263, current outputs signals 264, and LEDs 225A-C, other quantities may be implemented as well.

In some example embodiments, LED driver 205 may include an input voltage 270 (labeled VBAT), which may be provided by one or more batteries, capacitors, and the like. Furthermore, LED driver 205 may include additional inputs, such as a digital control bus interface 270 (labeled as for example I2C), a strobe input 270C for momentarily triggering the current output 264 and thus powering LEDs 225A-C on, a torch 270D input for triggering the current outputs 264 and thus LEDs 225A-C to turn on, a mask 270E which may be used to momentarily reduce or stop the LED current (which may also be controlled via I2C 270B), and an enable input 270F for placing the device in standby. The LED driver may also include an inductor 272 for direct-current to direct-current operation.

Although FIG. 2A depicts certain inputs 270A-F, the inputs to LED driver 205 may take other forms. For example, LED driver may be operated without one or more of the inputs 270A-F, such as strobe signal 270 (in which case control may be performed via I2C 270B). The controlling of the LED driver may include configuring driver 205 for flash mode, torch mode, start the flash pulse or torch, and/or stop the pulse or torch. The control may be performed in part via I2C 270B as well as in other ways including one or more general purpose input output pins.

Figure 2B:
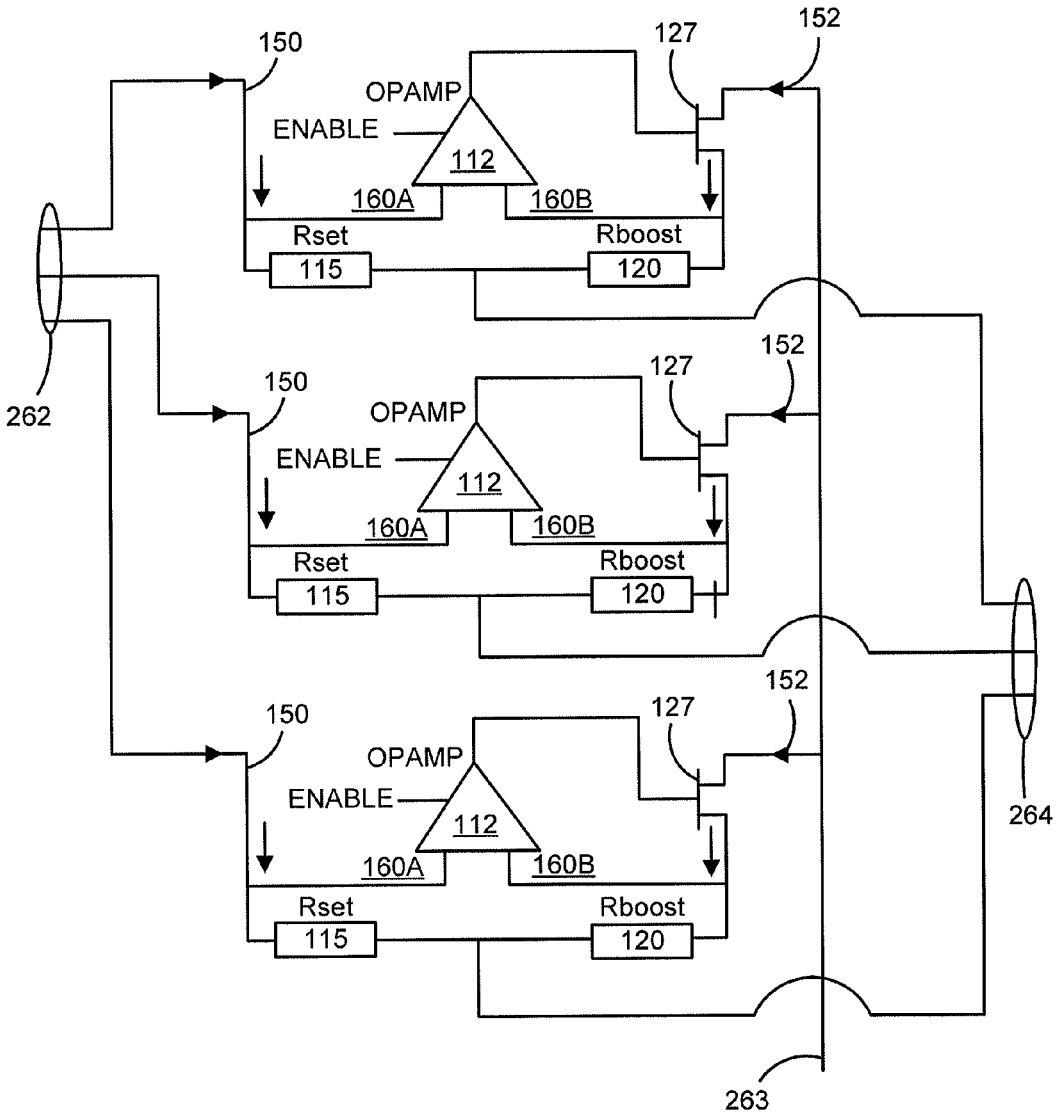
FIG. 2B depicts an example of combiner circuitry, in accordance with some example embodiments.

Combiner 290 may be configured as circuitry to generate output current signals 264 that are a function of $R_{set}$ and $R_{boost}$ resistors as noted above in Equation 1. In some example embodiments, combiner circuitry 290 may, as noted, be implemented in a similar manner as described above with respect to combiner circuitry 190. Moreover, each of the input current signals 262 from LED driver 205 may, in some example embodiments, have corresponding combiner circuitry including an operational amplifier, first and second resistors (for the $R_{set}$ and $R_{boost}$), and a current controller. An example implementation for combiner 290 is depicted at FIG. 2B, in accordance with some example embodiments. As shown, each of the current inputs has a corresponding combiner channel with an operational amplifier, first and second resistors, and a current controller, although other implementation configurations may be used as well.

Figure 2C:
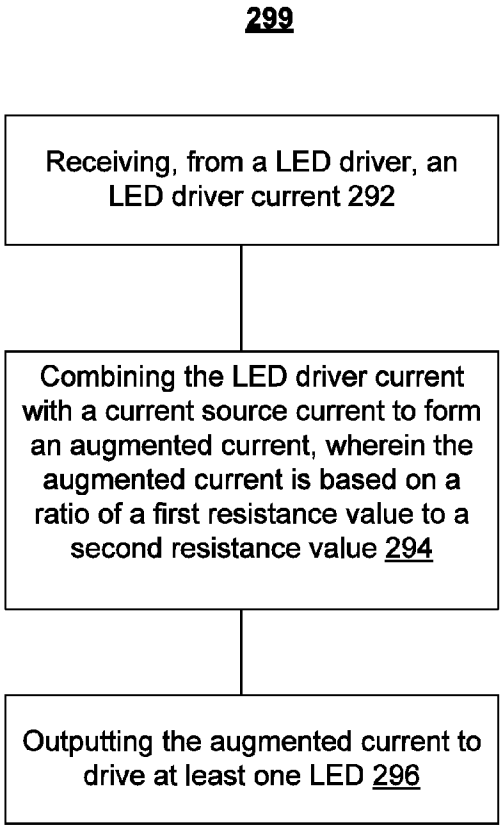
FIG. 2C depicts an example process for generating currents for LEDs, in accordance with some example embodiments.

FIG. 2C depicts an example process 299 for generating an augmented current for one or more LEDs, in accordance with some example embodiments. The description of FIG. 2B also refers to FIGS. 1 and 2A.

At 292, combiner circuitry may receive from an LED driver a current signal from an LED driver, in accordance with some example embodiments. For example, combiner circuitry 190/290 may receive a current signal 150/262 from LED driver 105/205.

At 294, combiner circuitry may combine the LED driver current signal received at 292 with a second current signal received from a high current/power source to form an augmented current signal, and this current signal may be based on a ratio of first and second resistance values, in accordance with some example embodiments. For example, combiner circuitry 190/290 may combine first LED current signal 150 with the current 152/263 from the high current source 110/210 to form an augmented current, $I_{total}$, for the LED 125/225A-C. The current, $I_{total}$, may be a function of the first resistance value 115 and the second resistance value 120. Moreover, current, $I_{total}$, may be a function a ratio of the first and second resistance values 115, 120 in accordance with for example Equation 1 above.

At 296, the current, $I_{total}$, may be provided to one or more LEDs, such as LED 125/225A-C, in accordance with some example embodiments. As such, the LED(s) may receive additional current, when compared to being driven only by LED driver 105/205.

Figure 3:
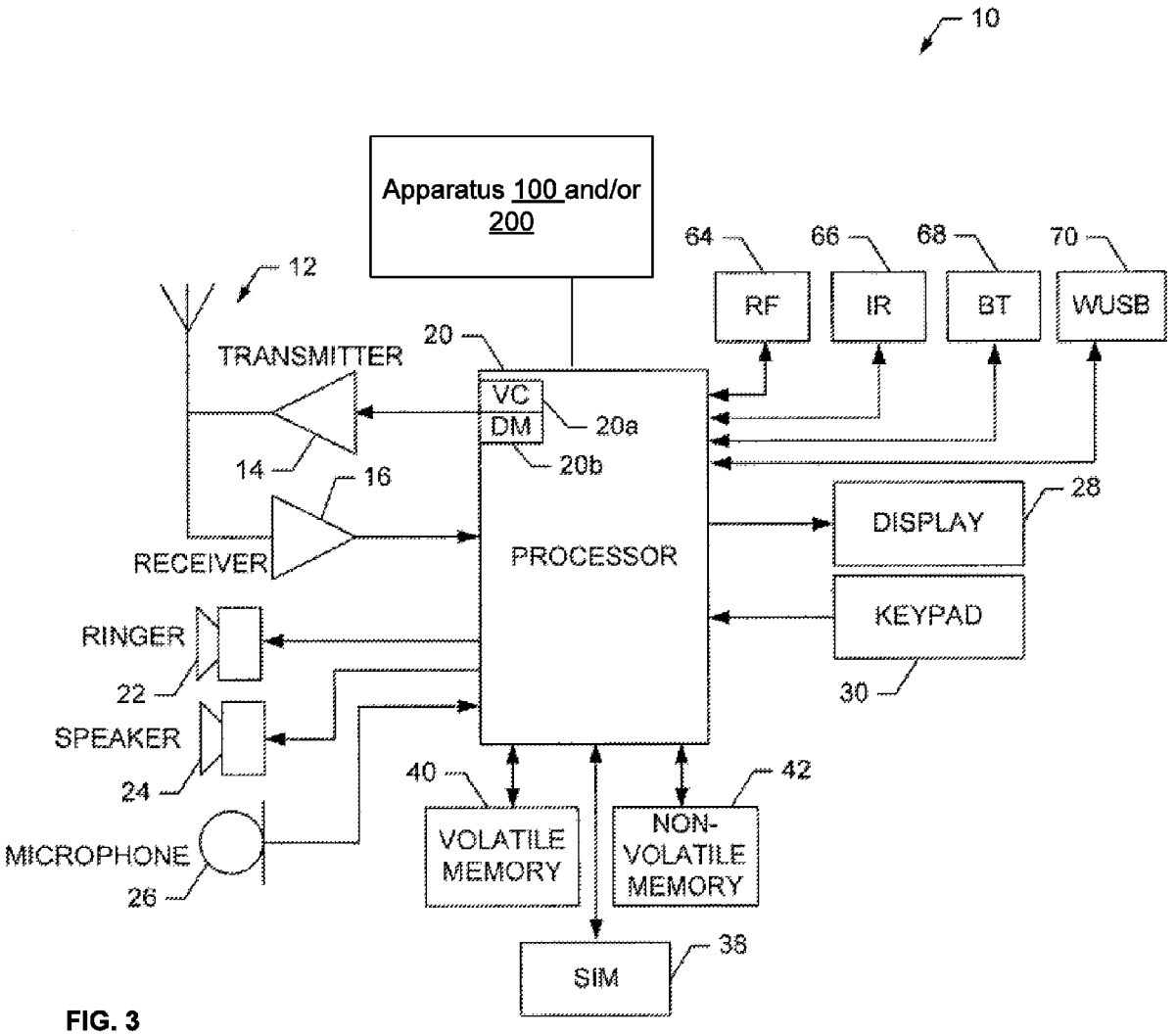
FIG. 3 depicts an example of a user equipment, in accordance with some example embodiments.

FIG. 3 illustrates a block diagram of an apparatus 10, in accordance with some example embodiments. The apparatus 10 may comprise a user equipment, such as a phone, a camera, a smartphone, any other device, and/or a combination thereof.

In some example embodiments, apparatus 10 may include the combiner 190 and/or combiner 290 disclosed herein to augment the current provided to one or more LEDs. For example, apparatus 10 may include the apparatus 100 and/or 200 disclosed herein.

The apparatus 10 may include at least one antenna 12 in communication with a transmitter 14 and a receiver 16. Alternatively transmit and receive antennas may be separate. The apparatus 10 may also include a processor 20 configured to provide signals to and receive signals from the transmitter and receiver, respectively, and to control the functioning of the apparatus. Processor 20 may be configured to control the functioning of the transmitter and receiver by effecting control signaling via electrical leads to the transmitter and receiver. Likewise, processor 20 may be configured to control other elements of apparatus 10 by effecting control signaling via electrical leads connecting processor 20 to the other elements, such as a display or a memory. The processor 20 may, for example, be embodied in a variety of ways including circuitry, at least one processing core, one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits (for example, an application specific integrated circuit (ASIC), a field programmable gate array (FPGA), and/or the like), or some combination thereof. Accordingly, although illustrated in FIG. 5 as a single processor, in some example embodiments the processor 20 may comprise a plurality of processors or processing cores.

Signals sent and received by the processor 20 may include signaling information in accordance with an air interface standard of an applicable cellular system, and/or any number of different wireline or wireless networking techniques, comprising but not limited to Wi-Fi, wireless local access network (WLAN) techniques, such as Institute of Electrical and Electronics Engineers (IEEE) 802.11, 802.16, and/or the like. In addition, these signals may include speech data, user generated data, user requested data, and/or the like.

The apparatus 10 may be capable of operating with one or more air interface standards, communication protocols, modulation types, access types, and/or the like. For example, the apparatus 10 and/or a cellular modem therein may be capable of operating in accordance with various first generation (1G) communication protocols, second generation (2G or 2.5G) communication protocols, third-generation (3G) communication protocols, fourth-generation (4G) communication protocols, Internet Protocol Multimedia Subsystem (IMS) communication protocols (for example, session initiation protocol (SIP) and/or the like. For example, the apparatus 10 may be capable of operating in accordance with 2G wireless communication protocols IS-136, Time Division Multiple Access TDMA, Global System for Mobile communications, GSM, IS-95, Code Division Multiple Access, CDMA, and/or the like. In addition, for example, the apparatus 10 may be capable of operating in accordance with 2.5G wireless communication protocols General Packet Radio Service (GPRS), Enhanced Data GSM Environment (EDGE), and/or the like. Further, for example, the apparatus 10 may be capable of operating in accordance with 3G wireless communication protocols, such as Universal Mobile Telecommunications System (UMTS), Code Division Multiple Access 2000 (CDMA2000), Wideband Code Division Multiple Access (WCDMA), Time Division-Synchronous Code Division Multiple Access (TD-SCDMA), and/or the like. The apparatus 10 may be additionally capable of operating in accordance with 3.9G wireless communication protocols, such as Long Term Evolution (LTE), Evolved Universal Terrestrial Radio Access Network (E-UTRAN), and/or the like. Additionally, for example, the apparatus 10 may be capable of operating in accordance with 4G wireless communication protocols, such as LTE Advanced and/or the like as well as similar wireless communication protocols that may be subsequently developed.

It is understood that the processor 20 may include circuitry for implementing audio/video and logic functions of apparatus 10. For example, the processor 20 may comprise a digital signal processor device, a microprocessor device, an analog-to-digital converter, a digital-to-analog converter, and/or the like. Control and signal processing functions of the apparatus 10 may be allocated between these devices according to their respective capabilities. The processor 20 may additionally comprise an internal voice coder (VC) 20*a*, an internal data modem (DM) 20*b*, and/or the like. Further, the processor 20 may include functionality to operate one or more software programs, which may be stored in memory. In general, processor 20 and stored software instructions may be configured to cause apparatus 10 to perform actions. For example, processor 20 may be capable of operating a connectivity program, such as a web browser. The connectivity program may allow the apparatus 10 to transmit and receive web content, such as location-based content, according to a protocol, such as wireless application protocol, WAP, hypertext transfer protocol, HTTP, and/or the like.

Apparatus 10 may also comprise a user interface including, for example, an earphone or speaker 24, a ringer 22, a microphone 26, a display 28, a user input interface, and/or the like, which may be operationally coupled to the processor 20. The display 28 may, as noted above, include a touch sensitive display, where a user may touch and/or gesture to make selections, enter values, and/or the like. The processor 20 may also include user interface circuitry configured to control at least some functions of one or more elements of the user interface, such as the speaker 24, the ringer 22, the microphone 26, the display 28, and/or the like. The processor 20 and/or user interface circuitry comprising the processor 20 may be configured to control one or more functions of one or more elements of the user interface through computer program instructions, for example, software and/or firmware, stored on a memory accessible to the processor 20, for example, volatile memory 40, non-volatile memory 42, and/or the like. The apparatus 10 may include a battery for powering various circuits related to the mobile terminal, for example, a circuit to provide mechanical vibration as a detectable output. The user input interface may comprise devices allowing the apparatus 20 to receive data, such as a keypad 30 (which can be a virtual keyboard presented on display 28 or an externally coupled keyboard) and/or other input devices.

As shown in FIG. 3, apparatus 10 may also include one or more mechanisms for sharing and/or obtaining data. For example, the apparatus 10 may include a short-range radio frequency (RF) transceiver and/or interrogator 64, so data may be shared with and/or obtained from electronic devices in accordance with RF techniques. The apparatus 10 may include other short-range transceivers, such as an infrared (IR) transceiver 66, a Bluetooth™ (BT) transceiver 68 operating using Bluetooth™ wireless technology, a wireless universal serial bus (USB) transceiver 70, a Bluetooth™ Low Energy transceiver, a ZigBee transceiver, an ANT transceiver, a cellular device-to-device transceiver, a wireless local area link transceiver, and/or any other short-range radio technology. Apparatus 10 and, in particular, the short-range transceiver may be capable of transmitting data to and/or receiving data from electronic devices within the proximity of the apparatus, such as within 10 meters, for example. The apparatus 10 including the Wi-Fi or wireless local area networking modem may also be capable of transmitting and/or receiving data from electronic devices according to various wireless networking techniques, including 6LoWpan, Wi-Fi, Wi-Fi low power, WLAN techniques such as IEEE 802.11 techniques, IEEE 802.15 techniques, IEEE 802.16 techniques, and/or the like.

The apparatus 10 may comprise memory, such as a subscriber identity module (SIM) 38, a removable user identity module (R-UIM), a eUICC, an UICC, and/or the like, which may store information elements related to a mobile subscriber. In addition to the SIM, the apparatus 10 may include other removable and/or fixed memory. The apparatus 10 may include volatile memory 40 and/or non-volatile memory 42. For example, volatile memory 40 may include Random Access Memory (RAM) including dynamic and/or static RAM, on-chip or off-chip cache memory, and/or the like. Non-volatile memory 42, which may be embedded and/or removable, may include, for example, read-only memory, flash memory, magnetic storage devices, for example, hard disks, floppy disk drives, magnetic tape, optical disc drives and/or media, non-volatile random access memory (NVRAM), and/or the like. Like volatile memory 40, non-volatile memory 42 may include a cache area for temporary storage of data. At least part of the volatile and/or non-volatile memory may be embedded in processor 20. The memories may store one or more software programs, instructions, pieces of information, data, and/or the like which may be used by the apparatus for performing operations, such as process 299 and/or any other operations/functions disclosed herein. The memories may comprise an identifier, such as an international mobile equipment identification (IMEI) code, capable of uniquely identifying apparatus 10. The memories may comprise an identifier, such as an international mobile equipment identification (IMEI) code, capable of uniquely identifying apparatus 10. In the example embodiment, the processor 20 may be configured using computer code stored at memory 40 and/or 42 to control and/or provide one or more aspects disclosed herein with respect to apparatus 100 and/or 200, such as receiving, at combiner circuitry, a first current from a light emitting diode driver circuitry; receiving, at the combiner circuitry, a second current from at least one of a capacitor or a battery; combining, by the combiner circuitry, the first current with the second current to form an augmented current, wherein the augmented current is based on at least a first value of a first resistor and a second value of a second resistor; and outputting, by the combiner circuitry, the augmented current to drive at least one light emitting diode.

Some of the embodiments disclosed herein may be implemented in software, hardware, application logic, or a combination of software, hardware, and application logic. The software, application logic, and/or hardware may reside on memory 40, the control apparatus 20, or electronic components, for example. In some example embodiment, the application logic, software or an instruction set is maintained on any one of various conventional computer-readable media. In the context of this document, a "computer-readable medium" may be any non-transitory media that can contain, store, communicate, propagate or transport the instructions for use by or in connection with an instruction execution system, apparatus, or device, such as a computer or data processor circuitry, with examples depicted at FIG. 3, computer-readable medium may comprise a non-transitory computer-readable storage medium that may be any media that can contain or store the instructions for use by or in connection with an instruction execution system, apparatus, or device, such as a computer.

Without in any way limiting the scope, interpretation, or application of the claims appearing below, a technical effect of one or more of the example embodiments disclosed herein is augmented current to one or more LEDs.

If desired, the different functions discussed herein may be performed in a different order and/or concurrently with each other. Furthermore, if desired, one or more of the above-described functions may be optional or may be combined. Although various aspects of the subject matter disclosed herein are set out in the independent claims, other aspects of the subject matter disclosed herein comprise other combinations of features from the described embodiments and/or the dependent claims with the features of the independent claims, and not solely the combinations explicitly set out in the claims. It is also noted herein that while the above describes example embodiments, these descriptions should not be viewed in a limiting sense. Rather, there are several variations and modifications that may be made without departing from the scope of the present subject matter disclosed herein as defined in the appended claims. Other embodiments may be within the scope of the following claims. The term "based on" includes "based on at least." The use of the phase "such as" means "such as for example" unless otherwise indicated.

What is claimed:

1. A method comprising:

providing, to a first resistor of a combiner circuitry, a driving signal having a first current from a light emitting diode driver circuitry, the combiner circuitry comprising a second resistor, a current controller, and an operational amplifier including a first operational amplifier input and a second operational amplifier input;

providing the driving signal to the first operational amplifier input, the first resistor coupled to the first operational amplifier input;

providing, to the current controller, a boost signal having a second current from at least one of a capacitor or a battery;

controlling, by the operational amplifier, the current controller via an operational amplifier output signal;

selectively providing, by the current controller, the boost signal to the second operational amplifier input and the second resistor, the second resistor coupled to the second operational amplifier input;

producing, by the first resistor, a first current component based at least in part upon the first current and a first value of the first resistor;

producing, by the second resistor, a second current component based at least in part upon the second current and a second value of the second resistor;

combining, by the combiner circuitry, the first current component with the second current component to form an augmented current; and outputting, by the combiner circuitry, the augmented current to drive at least one light emitting diode.

2. The method of claim 1, wherein the augmented current is based on at least a ratio of the first value of the first resistor and the second value of the second resistor.

3. The method of claim 1, wherein the first operational amplifier input and the second operational amplifier input are coupled, via the first resistor and the second resistor, to the at least one light emitting diode.

4. The method of claim 3, wherein the current controller comprises a transistor.

5. The method of claim 4, wherein the second operational amplifier input is coupled to an emitter of the transistor.

6. The method of claim 4, wherein the operational amplifier output signal is provided to a base of the transistor.

7. An apparatus comprising:

a first resistor configured to receive a driving signal having a first current from a light emitting diode driver circuitry, the first resistor configured to produce a first current component based at least in part upon the first current and a first value of the first resistor;

an operational amplifier including a first operational amplifier input and a second operational amplifier input, the first operational amplifier input configured to receive the driving signal, and the first resistor coupled to the first operational amplifier input;

a current controller configured to receive a boost signal having a second current from at least one of a capacitor or a battery; the current controller further configured to selectively provide the boost signal, based on an operational amplifier output signal, to the second operational amplifier input and a second resistor, wherein the second resistor is coupled to the second operational amplifier input;

the second resistor configured to produce a second current component based at least in part upon the second current and a second value of the second resistor; and a combiner circuitry configured to combine the first current component with the second current component to form an augmented current, and to output the augmented current to drive at least one light emitting diode.

8. The apparatus of claim 7, wherein the augmented current is based on at least a ratio of the first value of the first resistor and the second value of the second resistor.

9. The apparatus of claim 7, wherein first operational amplifier input and the second operational amplifier input are coupled, via the first resistor and the second resistor, to the at least one light emitting diode.

10. The apparatus of claim 9, wherein the current controller comprises a transistor.

11. The apparatus of claim 10, wherein the second operational amplifier input is coupled to an emitter of the transistor.

12. The apparatus of claim 10, wherein an operational amplifier output signal is provided to a base of the transistor.

13. A non-transitory computer-readable storage medium including computer program code which when executed by at least one processor causes operations comprising:

providing, to a first resistor of a combiner circuitry, a driving signal having a first current from a light emitting diode driver circuitry, the combiner circuitry comprising a second resistor, a current controller, and an operational amplifier including a first operational amplifier input and a second operational amplifier input;

providing the driving signal to the first operational amplifier input, the first resistor coupled to the first operational amplifier input;

providing, to the current controller, a boost signal having a second current from at least one of a capacitor or a battery;

controlling, by the operational amplifier, the current controller via an operational amplifier output signal;

selectively providing, by the current controller, the boost signal to the second operational amplifier input and the second resistor, the second resistor coupled to the second operational amplifier input;

producing, by the first resistor, a first current component based at least in part upon the first current and a first value of the first resistor;

producing, by the second resistor, a second current component based at least in part upon the second current and a second value of the second resistor;

combining, by the combiner circuitry, the first current component with the second current component to form an augmented current; and outputting, by the combiner circuitry, the augmented current to drive at least one light emitting diode.

14. The method of claim 1, wherein the operational amplifier is configured as a difference amplifier that controls the current controller so that a voltage across the second resistor is equal to a voltage across the first resistor.

15. The apparatus of claim 1, wherein the selectively providing of the boost signal is controlled so that a voltage at the first operational amplifier input and a voltage at the second operational amplifier input remain constant.

16. The apparatus of claim 7, wherein the operational amplifier is configured as a difference amplifier that controls the current controller so that a voltage across the second resistor is equal to a voltage across the first resistor.

17. The apparatus of claim7, wherein the selectively providing of the boost signal is controlled so that a voltage at the first operational amplifier input and a voltage at the second operational amplifier input remain constant.

* * * * *